United States Patent [19]

Cusick et al.

[11] Patent Number: 4,662,169

[45] Date of Patent: May 5, 1987

[54] PRODUCTION OF YARNS

[75] Inventors: Gordon E. Cusick, Cheshire, England; Murat A. Y. Susutoglu, Ankara, Turkey

[73] Assignee: The University of Manchester Institute of Science and Technology, England

[21] Appl. No.: 765,383

[22] Filed: Aug. 13, 1985

[30] Foreign Application Priority Data

Aug. 23, 1984 [GB] United Kingdom ..... 8421439

[51] Int. Cl.[4] ..... D01H 1/12; D01H 7/882; D01H 7/898

[52] U.S. Cl. ..... 57/401

[58] Field of Search ..... 57/400, 401, 334

[56] References Cited

U.S. PATENT DOCUMENTS 4,070,811 1/1978 Fehrer ..... 57/401
4,241,574 12/1980 Turk et al. ..... 57/401 X
4,281,507 8/1981 Didek et al. ..... 57/401
4,483,136 11/1984 Stahlecker et al. ..... 57/401

FOREIGN PATENT DOCUMENTS 95990 2/1973 Fed. Rep. of Germany .
1503475 3/1978 United Kingdom .
2013251 8/1979 United Kingdom .
1599101 9/1981 United Kingdom .
1600908 10/1981 United Kingdom .

*Primary Examiner*—Donald Watkins
*Attorney, Agent, or Firm*—Woodard, Weikart, Emhardt & Naughton

[57] ABSTRACT

In the friction spinning of yarns, staple fibres are supplied to a yarn formation zone in which the yarns end is rotated by frictional contact with at least one twisting element. In the yarn form zone, a jet of air is applied to the yarn or forming yarn by nozzle to increase the frictional forces between the yarn or forming yarn and the twisting elements. The formed yarn is continuously removed from the yarn formation zone.

24 Claims, 3 Drawing Figures

PRODUCTION OF YARNS

Figure 2:
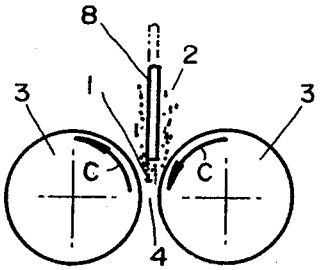

This invention relates to the friction spinning of yarns.

Friction spinning is a method of forming a yarn in which staple fibres are supplied, usually with a suitable medium (e.g. an air stream) to a yarn formation zone in which the yarn end is rotated by friction whereby the fibres are incorporated into the continuously forming yarn which is continuously taken off from the yarn formation zone. The yarn formation zone is usually defined between two or more twisting elements the surfaces of which move relative to each other (usually in opposite directions) whereby the yarn end is rotated by said surfaces. Thus, the twisting elements may be rollers, discs, belts, drums of the like (herein referred to generically as rollers) between the external surfaces of which is defined the yarn formation zone. Alternatively the yarn formation zone may be defined between the external surface of a roller and the internal surface of a drum in which the roller is mounted. It is also possible for the yarn formation zone to be defined between a combination of the aforementioned types of twisting elements, e.g. between a belt and a roller.

In a further possibility only one twisting element need be used to form the yarn formation zone. Thus, for example, the yarn may be held by suction on a single roller which is rotated to cause rotation of the yarn on the roller surface.

One known construction of friction spinning apparatus comprises two axially parallel rollers located in closely spaced relationship such that a yarn formation zone is defined between the two rollers. The yarn formation zone comprises a delivery zone to which the fibres are supplied and the twisting zone (see below). During a yarn production run, the rollers are rotated in the same direction (so that the surfaces of the rollers are moving in relatively opposite directions in the yarn formation zone) and staple fibres are fed to one side of the nip defined between the two rollers and spun yarn is drawn off along the direction of the nip. The fibres may be delivered in any direction to the nip and may be guided to the nip through a slot. One or both rollers may be perforated so that the fibres may be drawn onto the rollers by suction applied within the rollers.

The fibres are delivered to the nip along a length thereof known as the delivery zone and the forming yarn passed along the so called twisting zone in the direction of yarn removal. In the delivery zone, twist is inserted into the fibres by the rollers. As a result of this twisting, the fibres join the yarn end and as the yarn is drawn off further twist is inserted into the yarn in twisting zone by virtue of the frictional contact between the rotating rollers and the yarn. The frictional contact between the fibres and/or yarn and the rotating rollers may be enhanced by the abovementioned suction.

Experience has shown that the twisting efficiency of these processes is low (sometimes less than 20%) because of tangential slippage between the forming yarn and the rotating rollers.

Additionally, experience has shown that these processes produce yarn at relatively low tensions due to the low normal force between the rollers and the forming yarn.

The above problems limit or affect the process and/or product thereof in the following respects:

(1) the rate at which yarn of given twist may be produced;
(2) the twist in a yarn produced at a given rate;
(3) the strength of the yarn; and
(4) the density and structure of the yarn, in particular with respect to the radial distribution of twist.

It is an object of the invention to obviate or mitigate the abovementioned disadvantages.

According to the present invention there is provided a method of friction spinning yarn by supplying staple fibres to a yarn formation zone in which the yarn end is rotated by frictional contact with at least one twisting element and withdrawing yarn from the yarn formation zone wherein a jet of air is applied to the yarn or forming yarn in the yarn formation zone to increase the frictional forces between the yarn (or forming yarn) and the twisting element.

The use of air jet increases the tangential and axial frictional forces between the yarn (or forming yarn) and the twisting element or elements and ensures an improvement in the efficiency of the twisting process. Also, the air jet serves to increase the axial tension and also increase the yarn cohesiveness by compacting the yarn structure.

The invention also provides friction spinning apparatus comprising a yarn formation zone including at least one twisting element for rotating a yarn end by frictional contact and means for withdrawing yarn from the yarn formation zone wherein air jet means is provided for directing a jet of air into the yarn formation zone to increase frictional forces between yarn or forming yarn and the twisting element.

Preferably the yarn formation zone is defined between two twisting elements (e.g. as exemplified above) the surfaces of which are moving in relatively opposite directions in the yarn formation zone.

Figure 1:
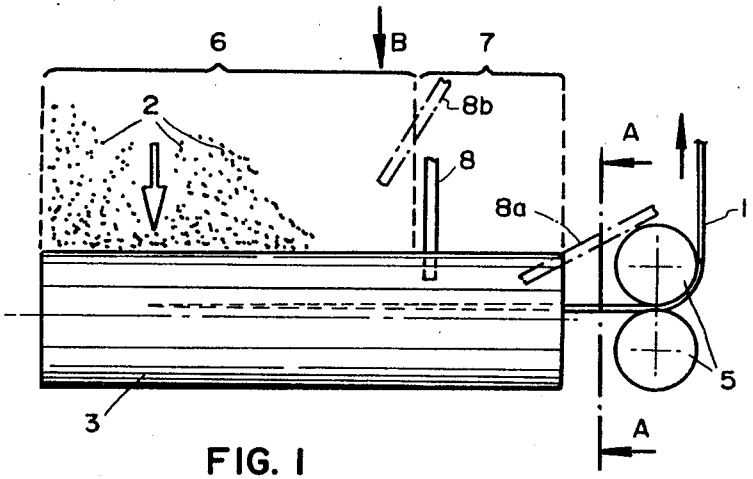
Figure 3:
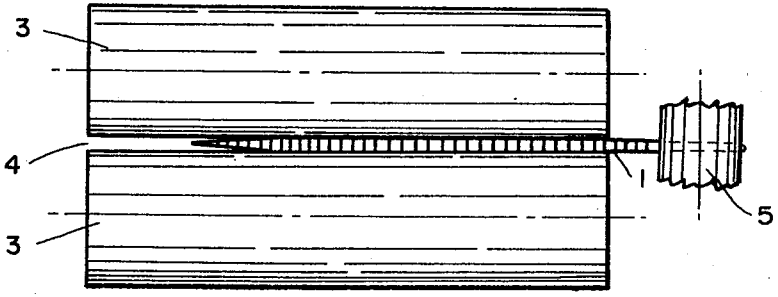

The invention will be further described by way of example only with reference to the accompanying drawings in which:

FIG. 1 diagrammatically illustrates one embodiment of friction spinning apparatus for carrying out the method of the first aspect of the invention;

FIG. 2 is an end view of the apparatus diagrammatically illustrated in FIG. 1 and looking in the direction of arrow A shown therein; and FIG. 3 is a plan view of the apparatus diagrammatically illustrated in FIG. 1 and looking in the direction of arrow B shown therein but omitting details of the nozzle and delivery rollers; and As illustrated in the drawings, yarn 1 is produced from staple fibres 2 in a friction spinning apparatus which comprises two axially parallel, closely spaced rollers 3 between which is defined a nip 4. Rollers 3 are rotated in the same direction (arrows C in FIG. 2) and a pair of yarn delivery rollers 5 are provided for withdrawing yarn 1 along the direction of the nip 4.

The staple fibres are fed to the nip 4 (preferably in a delivery air stream) over a delivery zone 6 in which a degree of twist is imparted to the fibres to join them to the yarn end and the yarn 2 then passes along a twisting zone 7 before being withdrawn from the rollers 3 by the delivery rollers 5.

As thus far described, the friction spinning apparatus is conventional. However in accordance with the invention, a nozzle 8 is provided for directing a jet of air into the nip 4 to press the yarn 1 and/or fibres 2 therein to increase frictional cotact with the rollers 3.

As illustrated in FIG. 1, nozzle is positioned to direct the air jet perpendicularly into the twisting zone 7. However a variety of alternative positions may be used for the nozzle, some of which are shown in chain dot line in FIG. 1. Thus the nozzle (depicted as 8*a* in FIG. 1) may be positioned to provide an angled air jet into twisting zone 7. Alternatively the nozzle (depicted as 8*b* in FIG. 1) may be positioned to direct an air jet into the delivery zone 6 of the nip 4. It should be appreciated that jet 8 (or 8*a* or 8*b*) may be positioned at any convenient angle.

Purely by way of example, the nozzles 8, 8*a* and 8*b* may be circular section tubes with an internal diameter of 3–5 mm although tubes with various sections may be used. The air pressure supplied to the nozzle 8, 8*a* or 8*b* may, for example, be up to 4 bar with the higher pressures giving the better results. The optimum combination of cross-sectional shape and size of nozzle and the air pressure for any particular friction spinning apparatus is however likely to be dependent on that apparatus and the mass/unit length of the yarn to be produced. As is apparent from the foregoing description and the figures, the air jet is "localised," meaning that the jet is substantially a "point jet" which does not extend significantly along the yarn formation zone. FIG. 2 shows, for example, that the jet is about the size of the yarn or forming yarn in the nip 4. The size of the air jet directed against the yarn or forming yarn is therefore seen to be substantially smaller than the length of either the delivery zone 6 or the twisting zone 7.

It is of course possible to provide more than one nozzle, e.g. one for directing an air jet into the delivery zone 6 and one for directing an air jet into the twisting zone 7. Alternatively it is possible to use two nozzles positioned for directing air to opposite sides of the nip 4. In this case the nozzle positioned on the same side of the nip 4 as that to which the fibres 2 are fed provides the greater pressure. The use of two nozzles positioned on opposite sides of the nip 4 may have advantages in certain cases.

The following tests and results therefor illustrate the advantages of the first aspect of the invention;

With 60 mm, 3.3. dtex acrylic fibre on the DREF 2 friction spinning machine a 300 tex yarn was spun both without and with the use of an air jet. the ratio of the surface speed of the spinning drums perpendicular to the yarn speed was held constant at 3.6. These results were obtained:

| | | Without Jet | With Jet |
|---|---|---|---|
| (a) | Yarn Speed | 120 m/min | 120 m/min |
| | Yarn tenacity | 6.0 cN/tex | 9.5 cN/tex |
| (b) | Yarn speed | 170/min | 270 m/min |
| | Yarn tenacity | 4.0 cN/tex | 8.5 cN/tex |

In summary, the invention provides the following advantages:

(1) The yarn is pressed further onto the twisting elements.

(2) The frictional force between the yarn and the surface of the spinning rollers is increased.

(3) The amount of twist inserted in the yarn is increased.

(4) There is a more uniform radial distribution of twist across the yarn.

(5) The yarn is produced at higher axial tension.

(6) Yarn may be produced at higher production speeds.

(7) Yarn strength may be increased.

(8) Yarn strength and structure, for example with regard to compactness and hairiness, are affected advantageously.

(9) The requirement for suction from inside the roller or rollers may be decreased.

(10) The surfaces of the rollers need not be of high friction material.

(11) The spinning of yarns from very rigid fibres such as aramid fibre is made possible at high speeds.

It should be appreciated that the method of the invention may be used to spin a sheath of fibres around a preformed elongate component. In this case, an elongate component (for example a preformed yarn, a continuous filament yarn, a tape, a metal wire etc) supplied axially to the delivery zone 6 in addition to the fibres 2 and these fibres 2 then become twisted around the elongate component. This method may be used to form core yarns, the production of which by friction spinning is conventional.

Alternatively a sheath of staple fibres may be spun around a core of separately delivered staple fibres supplied axially to the delivery zone 6.

A combination of the methods described in the two preceding paragraphs may be used.

The jets may be used for spinning yarns without the supply of sheath fibres in which case the yarn is formed from the staple fibres and/or elongate component supplied axially to the yarn formation zone.

What is claimed is:

1. A method of friction spinning yarn by supplying staple fibres to a yarn formation zone in which the yarn end is rotated by frictional contact with at least one twisting element and withdrawing yarn from the yarn formation zone wherein a localised jet of air is applied to the yarn or forming yarn in the yarn formation zone to increase the frictional forces between the yarn or forming yarn and the twisting elements.

2. A method as claimed in claim 1 wherein two twisting elements are provided the surfaces of which move in relatively opposite directions in the yarn formation zone.

3. A method as claimed in claim 2 wherein the twisting elements comprise a pair of axially parallel rollers rotating in the same direction.

4. A method as claimed in claim 1 wherein the yarn formation zone is sub-divided into a delivery zone and a twisting zone and the jet of air is directed into the twisting zone.

5. A method as claimed in claim 4 wherein the fibres be supplied to the delivery zone in an air stream.

6. A method as claimed in claim 1 wherein the jet of air is supplied by a nozzle.

7. A method as claimed in any one of claim 6 wherein the nozzle is a circular section tube.

8. A method as claimed in claim 6 wherein the air pressure supplied to the nozzle is 4 bar or less.

9. Friction spinning apparatus comprising a yarn formation zone including at least one twisting element for rotating a yarn end by frictional contact and means for withdrawing yarn from the yarn formation zone wherein localised air jet means is provided for directing a localised jet of air into the yarn formation zone to increase frictional forces between yarn or forming yarn and the twisting element.

10. Friction spinning apparatus as claimed in claim 9 wherein two twisting elements are provided the surfaces of which are moveable in relatively opposite directions in the yarn formation zone.

11. Friction spinning apparatus as claimed in claim 10 wherein the twisting elements comprise a pair of axially parallel rollers.

12. Apparatus as claimed in claim 9 wherein the yarn formation zone is sub-divided into the delivery zone and a twisting zone and the air jet means is adapted to direct the air jet into the twisting zone.

13. Apparatus as claimed in claim 9 wherein the air jet means comprises a circular section tube.

14. The method of claim 1 in which the localised jet of air is a point jet.

15. The method of claim 1 in which the yarn formation zone is sub-divided into a delivery zone and a twisting zone and the localised jet of air is directed into the delivery zone.

16. The method of claim 15 and which includes a second localised jet of air applied to the yarn or forming yarn in the twisting zone.

17. The method of claim 4 in which the jet of air is directed into the twisting zone at an angle other than perpendicular to the yarn or forming yarn.

18. The method of claim 4 in which the jet of air is applied to the yarn only along a length substantially less than the length of the twisting zone.

19. The method of claim 6 in which the air pressure supplied to the nozzle is about 4 bar.

20. The apparatus of claim 9 in which the localised jet of air is a point jet.

21. The apparatus of claim 9 in which the yarn formation zone is sub-divided into a delivery zone and a twisting zone and the localised jet of air is directed into the delivery zone.

22. The apparatus of claim 21 in which said localised air jet means is further for directing a second localised jet of air into the yarn formation zone, the second localised jet of air being directed at the yarn or forming yarn in the twisting zone.

23. The apparatus of claim 12 in which the jet of air is directed into the twisting zone at an angle other than perpendicular to the yarn or forming yarn.

24. The apparatus of claim 12 in which the jet of air is supplied to the yarn only along a length substantially less than the length of the twisting zone.

* * * * *